US008498378B2

(12) United States Patent
Lemarchand et al.

(10) Patent No.: US 8,498,378 B2
(45) Date of Patent: Jul. 30, 2013

(54) METHOD TO CONTROL THE EMISSION OF A BEAM OF ELECTRONS IN A CATHODE, CORRESPONDING CATHODE, TUBE AND IMAGING SYSTEM

(75) Inventors: Gwenael Lemarchand, Limours (FR); Frederic Dahan, Le Chesnay (FR); Christelle Gaudin, St. Maurice (FR)

(73) Assignee: General Electric Company, Schenectady, NY (US)

( * ) Notice: Subject to any disclaimer, the term of this patent is extended or adjusted under 35 U.S.C. 154(b) by 203 days.

(21) Appl. No.: 12/829,850

(22) Filed: Jul. 2, 2010

(65) Prior Publication Data

US 2011/0002447 A1 Jan. 6, 2011

(30) Foreign Application Priority Data

Jul. 6, 2009 (FR) ..... 0954636

(51) Int. Cl.
*H01J 35/06* (2006.01)
*H01J 35/14* (2006.01)
*H01J 35/30* (2006.01)

(52) U.S. Cl.
USPC ..... 378/134; 378/136; 378/137; 378/138

(58) Field of Classification Search
USPC ..... 378/134, 136, 137, 138
See application file for complete search history.

(56) References Cited

U.S. PATENT DOCUMENTS 4,685,118 A * 8/1987 Furbee et al. ..... 378/114
4,689,809 A * 8/1987 Sohval ..... 378/136
4,764,947 A * 8/1988 Lesensky ..... 378/136
4,823,371 A * 4/1989 Grady ..... 378/134
5,224,143 A * 6/1993 Dumitrescu et al. ..... 378/136
5,303,281 A * 4/1994 Koller et al. ..... 378/134
5,511,105 A * 4/1996 Knott ..... 378/134
5,535,254 A * 7/1996 Carlson ..... 378/113
5,617,464 A * 4/1997 Mika et al. ..... 378/137
5,623,530 A * 4/1997 Lu et al. ..... 378/136
5,742,662 A * 4/1998 Kuhn et al. ..... 378/138
6,333,969 B1 * 12/2001 Kujirai ..... 378/138
6,438,207 B1 * 8/2002 Chidester et al. ..... 378/138
6,480,572 B2 * 11/2002 Harris et al. ..... 378/136
6,801,599 B1 * 10/2004 Kautz et al. ..... 378/138
6,944,268 B2 * 9/2005 Shimono ..... 378/111
6,968,039 B2 * 11/2005 Lemaitre et al. ..... 378/138
6,980,623 B2 * 12/2005 Dunham et al. ..... 378/19
7,085,354 B2 * 8/2006 Kanagami ..... 378/136

(Continued)

FOREIGN PATENT DOCUMENTS

FR 2680046 A1 2/2003
WO 2008122971 A1 10/2008

*Primary Examiner* — Allen C. Ho
(74) *Attorney, Agent, or Firm* — Global Patent Operation

(57) ABSTRACT

A method for controlling emission of a beam of electrons in an X-ray imaging tube. The X-ray imaging tube has an anode and a cathode. The method comprises a step in which at least one emission device included in the cathode emits an accelerated incident beam of electrons onto an impact focal spot on the anode to generate X-rays. An emission device is associated firstly with an assembly of polarizing plates and secondly with a focusing cup. An electric generator simultaneously applies a beam focusing voltage to the assembly and/or to the cup to control a characteristic dimension of the focal spot, and a cut-off voltage to the cup to control the emission of the beam by the device. The invention also concerns a corresponding cathode, tube and imaging system.

5 Claims, 2 Drawing Sheets

U.S. PATENT DOCUMENTS 7,327,829 B2 * 2/2008 Chidester ..... 378/136
7,496,180 B1 * 2/2009 Subraya et al. ..... 378/137
7,529,344 B2 * 5/2009 Oreper ..... 378/134
7,657,002 B2 * 2/2010 Burke et al. ..... 378/136
7,792,241 B2 * 9/2010 Wu et al. ..... 378/16
2002/0126798 A1 9/2002 Harris et al.

* cited by examiner

METHOD TO CONTROL THE EMISSION OF A BEAM OF ELECTRONS IN A CATHODE, CORRESPONDING CATHODE, TUBE AND IMAGING SYSTEM

CROSS-REFERENCE TO RELATED APPLICATION

This application claims priority under 35 U.S.C. §119(a)-(d) or (f) to prior-filed, co-pending French application number 0954636, filed on Jul. 6, 2009, which is hereby incorporated by reference in its entirety.

BACKGROUND OF THE INVENTION

1. Field of Invention

The invention concerns a method to control the emission of an electron beam in an X-ray imaging tube. The invention also concerns an electron-emitting cathode, a tube, and an X-ray imaging system to implement said method.

2. Description of Related Art

In known X-ray imaging systems, such as scanners for medical applications, an imaging tube emits X-rays which pass through an object to be observed, e.g. part of a patient's body, said X-rays then being detected by an array of detectors which allows an image of the object to be constructed.

Imaging tubes generally consist of a cathode capable of emitting an incident beam of electrons onto an impact focal spot on an anode, the cathode and the anode being separated by a vacuum.

The cathode typically comprises an electron-emitting device, consisting for example of a coiled tungsten filament and heated to high temperature via an electric current, which allows the beam of electrons to be generated. The electrons are then accelerated in the vacuum between the cathode and anode by means of an electric voltage difference applied between the cathode and anode.

The anode, typically a target in tungsten, which may rotate, then generates the X-rays after its interaction with the beam of electrons.

The design of the cathode is subject to various contradictory constraints, depending upon the use made of the associated imaging system. The constraints differ if the imaging system is used in neurology, cardiology or mammography for example.

One constraint is that the emission device of the cathode must generate a beam of electrons containing a sufficient number of electrons in order to obtain good image quality. The number of electrons in the beam depends, in particular, on the temperature of the filament of the emission device, called the emission temperature. To generate a beam containing a higher number of electrons, a large filament is most often used since it can emit a higher number of electrons at one same temperature and hence at one same rate of consumption or evaporation. Evidently, the increase in temperature is made to the detriment of the lifetime of the emission device, whose filament may finally break after evaporation at high temperature.

A further constraint is the size of the focal spot of the electron beam on the anode. The smaller the focal spot, the greater the resolution of the final image since finer details will be able to be distinguished.

Reducing the size of the impact focal spot can be achieved passively i.e. using a smaller filament and/or arranging the filament of the emission device in a focusing cup whose mechanical profile, e.g. stepped shape, allows the beam to be concentrated, and/or it can be achieved actively which is generally obtained by applying a negative voltage to polarizing plates located in the vicinity of the emission device which allows the beam of electrons to be concentrated onto a smaller focal spot by means of electrostatic forces.

Some applications, in particular medical observation applications of a patient via the X-ray imaging system require a beam of electrons emitted in different emission modes which persons skilled in the art call "fluoro" emission mode and "record" emission mode.

The fluoro emission mode is a pulsed emission mode of the beam of electrons, used when observing a patient over a long period or over a large part of the body, for which the patient's radiation dose must be reduced and for which low image quality is sufficient. Therefore, in the fluoro mode one possibility consists of reducing the radiation dose in each pulse, so as to minimize the patient's radiation dose during exposure. This is also called low power pulsed emission mode. It is also possible to reduce non-necessary patient radiation by controlling the duration of each pulse through the periodic application of a cut-off voltage to a focusing cup located in the vicinity of the emission device, which allows blocking of the electrons in the emission device through the repelling effect of electrostatic forces. Therefore, between two pulses, the emission of the electron beam is cut off and there is no patient radiation. This also takes part in better image quality.

The record emission mode is a pulsed emission mode of a beam of electrons, used when observing a patient over a short period of time or over a small part of the body, for which good image quality is necessary. Good image quality requires high irradiating power. In this case the term high power pulsed emission mode is used. Between the taking of two images, the high acceleration voltage of the electron beam is cut off. However, no cut-off voltage is applied to the focusing cup, which may generate remanent radiation for the patient since the cut-off of the high acceleration voltage is not instantaneous.

One disadvantage of prior art solutions is that they do not offer emission devices allowing simultaneous active reducing of focal spot size and a fluoro emission mode. In general, prior art tubes have a first emission device comprising a small filament located in a focusing cup to which a cut-off voltage can be applied for observation in fluoro mode, and a separate second emission device comprising a large filament for observation in record mode.

These solutions are therefore not flexible, and since the fluoro mode is used for long periods and is the most utilized mode in the imaging system, the small filament emission device is given intensive use, which reduces its lifetime.

Another drawback of some prior art solutions is that they do not allow the reconciling of high emission temperature to obtain good image quality (which generally assumes the use of a large filament) with the obtaining of a small-size focal spot, also to ensure good image resolution, whilst maintaining a long lifetime of the emission device.

BRIEF SUMMARY OF THE INVENTION

The invention proposes a method allowing at least one of the above-mentioned disadvantages to be solved. For this purpose, the invention proposes a method to control the emission of a beam of electrons in an X-ray imaging tube comprising an anode and a cathode. The method comprising a step in which at least one emission device included in the cathode emits an accelerated incident beam of electrons to an impact point on the anode to generate X-rays. Said method being characterized in that it comprises the steps according to which the emission device being associated firstly with an assembly of polarizing plates and secondly with a focusing cup. An electric generator simultaneously applies a beam focusing voltage to the assembly and/or the focusing cup to control a characteristic dimension of the focal spot and a cut-off voltage to the focusing cup—to control emission of the beam in fluoro mode by the device.

The generator may apply a cut-off voltage and a focusing voltage for the device. Said focusing voltage being less by a value ranging from −2 kV to −6 kV than an acceleration voltage of the beam of electrons applied to the acceleration device, so that the beam is emitted in fluoro mode and the characteristic dimension of its focal spot lies between 0.1 mm and 0.5 mm. The generator may apply a cut-off voltage and a focusing voltage for the device, said focusing voltage being less by a value ranging from −2 kV to −6 kV or from −4 kV to −10 kV than an acceleration voltage of the beam of electrons applied to the acceleration device, so that the beam is emitted in fluoro mode and the characteristic dimension of its focal spot lies between 0.7 mm and 1.2 mm or between 0.4 mm and 0.8 mm. The cathode may comprise a first emission device and a second emission device. The generator may alternately control the first device and the second device, so that the first device and the second device alternately emit electron beams in fluoro mode.

The alternate controlling being performed: firstly, by applying a cut-off voltage to the focusing cup associated with the first emission device, whose emitted beam focuses on a first focal spot on the anode with a first characteristic impact dimension; and secondly, by applying simultaneously a focusing voltage and a cut-off voltage for the second emission device, whose emitted beam focuses on a second focal spot on the anode with a second characteristic impact dimension, so that the first dimension and the second dimension are substantially equal; and the focusing voltage for the second device is less by a value of between −4 kV and −10 kV than the acceleration voltage of the beam of electrons applied to the second device, so that the first dimension and the second dimension are substantially equal and lie between 0.4 mm and 0.8 mm.

The invention also concerns a cathode for an X-ray imaging tube comprising an anode. Said cathode comprising at least one emission device capable of emitting an incident beam of electrons onto an impact point on the anode to generate X-rays. The emission device may be associated firstly with an assembly of polarizing plates and secondly with a focusing cup, in the cathode, the assembly and the cup being electrically insulated from each other and from the emission device via insulating means, the assembly and/or cup able to be subjected to an electric focusing voltage, and the cup further being able to be subjected to an electric cut-off voltage simultaneously with application of the focusing voltage, applied by an electric generator, firstly to control the characteristic dimension of the focal spot via the focusing voltage and secondly to control emission of the beam in fluoro mode by the device via the cut-off voltage.

The cathode of the invention is advantageously completed by the following characteristic: it comprises at least two emission devices, in which each emission device comprises an emitting filament having a geometric configuration that is different for each device.

The invention also concerns an X-ray imaging tube comprising an anode and a cathode according to the invention, and an imaging system comprising an X-ray tube according to the invention and an electric generator, capable of simultaneously applying a beam focusing voltage to the assembly and/or cup to control the characteristic dimension of the focal spot and a cut-off voltage to the cup to control emission of the beam in fluoro mode by the device.

One advantage of the invention is to propose a solution allowing simultaneous control over fluoro emission mode and control over the reduced size of the focal spot of an electron beam. Therefore with the invention it is notably possible to obtain an emission device capable of emitting a beam of electrons in fluoro emission mode, the focal spot of the electron beam being controlled so that it lies in the ranges of between 1.0 mm and 1.5 mm, 0.7 mm and 1.2 mm or 0.4 mm and 0.8 mm.

The invention also provides an emission device capable of emitting an electron beam in fluoro emission mode, the focal spot of the electron beam able to be controlled so that it lies between 0.4 mm and 0.8 mm or 0.1 mm and 0.5 mm.

A further advantage of the invention is to propose a solution which extends the lifetime of the emission devices. In particular, the invention proposes the use of a cathode comprising first and second emission devices, the two devices being capable of emitting an electron beam in fluoro emission mode, the focal spot of the electron beam being controlled so that it lies between 0.4 mm and 0.8 mm. Therefore, the two emission devices can be used alternately for the same application which extends the lifetime of the cathode. Additionally, the emission temperature of each of the two emission devices can be increased without reducing the lifetime of the cathode, since said cathode is based on the alternate use of the two emission devices which reduces the utilization and hence the wear of each device.

A further advantage of the invention is to propose a solution allowing increased emission to be reconciled with a reduced focal spot size of an electron beam. Therefore, the invention notably proposes an emission device comprising a large filament, emitting a beam of electrons whose focal spot lies between 1.0 mm and 1.5 mm, capable of emitting an electron beam with a smaller focal spot (between 0.4 mm and 0.8 mm) which allows increased emission temperature to be reconciled with a reduction in focal spot size. Additionally, the large filament better withstands increased emission than a small filament in terms of lifetime.

Finally, a further advantage of the invention is to propose a flexible solution allowing various modes of utilization of the emission devices in diverse applications. The invention particularly proposes a cathode comprising one or more emission devices for which simultaneous control is possible over fluoro or record emission mode and over reducing the size of the electron beam focal spot, which allows various fluoro or record emission modes to be obtained whose electron beams have different sized focal spots. The invention also proposes an emission device capable of emitting a beam of electrons in fluoro emission mode, for which the size of the focal spot is controlled so that it lies between 0.1 mm and 0.5 mm, this type of beam being of particular advantage for neurological observation.

BRIEF DESCRIPTION OF THE DRAWINGS

Other characteristics and advantages of the invention will become apparent from the following description which is solely given for illustration purposes and is non-limiting, and is to be read with reference to the appended drawings in which.

DETAILED DESCRIPTION

Figure 1:
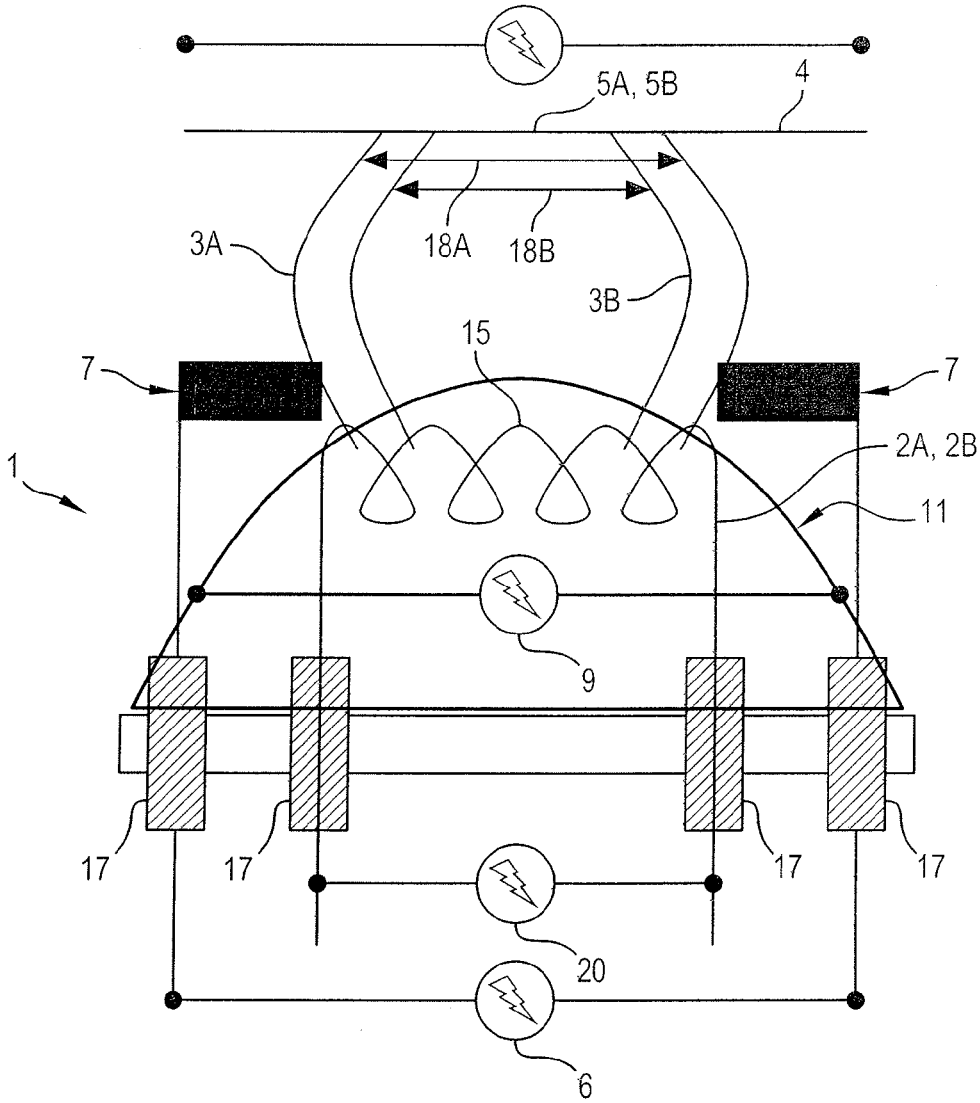
FIG. 1 is a schematic illustration in profile of a cathode according to the invention.
Figure 2:
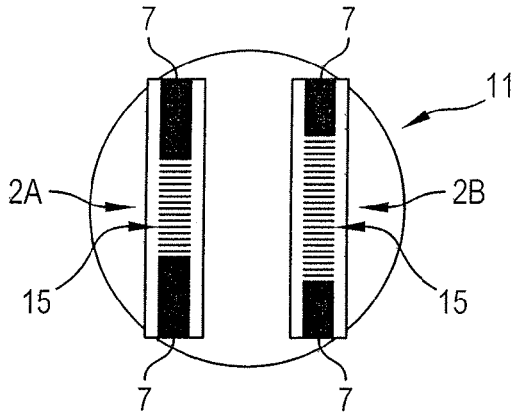
FIG. 2 is a schematic illustration of an overhead view of a cathode according to the invention.

FIGS. 1 and 2 show a diagram of a cathode 1 according to the invention.

The cathode 1 comprises at least one emission device 2A capable of emitting a beam of electrons 3A. The cathode 1 comprises as many emission devices as required.

In general, the emission device 2A comprises an emission filament 15, in which an electric current of several amperes is passed (e.g. 6 amperes) to heat said emission filament 15, which allows generation of a beam 3A of electrons. The filament 15 is heated to high temperature, higher than 2000° C. The filament 15 is typically a coiled tungsten wire.

The beam 3A of electrons is accelerated in the vacuum towards an anode 4. Acceleration of the beam is obtained by applying an electric voltage difference between the cathode 1 and the anode 4.

One solution consists of applying a negative acceleration voltage 20 in the order of −75 kV to the emission device 2A, and a positive electric voltage in the order of +75 kV to the anode 4, the potential difference between the cathode 1 and the anode 4 then being in the order of 150 kV. The potential difference to be applied between the cathode 1 and the anode 4 most often lies between 20 and 200 kV.

The beam 3A of electrons lies incident to a focal impact spot 5A on the anode 4. The interaction between the incident beam 3A of electrons and the constituent material of the anode 4 allows the generation of X-rays.

The emission device 2A is associated firstly with an assembly 7 of polarizing plates and secondly with a focusing cup 11, the assembly 7 and the cup 11 being located in the cathode 1.

The assembly 7 of polarizing plates comprises an assembly of plates, generally in metal, positioned either side of the emission device 2A.

The focusing cup 11 is a part that is preferably in metal whose shape e.g. incurved and stepped is chosen to concentrate the beam 3A of electrons and hence to reduce the size of the focal spot 5A of the beam 3A.

The assembly 7 and the cup 11 are electrically insulated from each other and from the emission device 2A via insulating means 17. The insulating means 17 are parts in insulating material, ceramic for example.

In the method of the invention, when the emission device 2A emits a beam 3A of electrons, an electric generator 8 simultaneously applied a beam focusing voltage 6 to the assembly 7 to adjust the length of the focal spot 5A and/or to the cup 11 to adjust the width of the focal spot 5A (the length and/or width are a characteristic dimension of the focal spot 5A), and a cut-off voltage 9 to the cup 11 to cut off the emission of electrons. In practice, part of the focusing, voltage can be applied to the assembly 7, and another part to the cup 11.

Since the assembly 7 of polarizing plates is positioned either side of the emission device 2A, the beam 3A of electrons will undergo focusing electrostatic forces due to the electric voltage applied to the assembly 7 and/or the cup 11. The focusing voltage 6 applied to the assembly 7 and/or the cup 11 then allows focusing of the beam 3A of electrons.

In particular, the focusing voltage 6 provides active control over the reduction in a characteristic dimension 18A of the focal spot 5A of the beam of electrons.

Most often, the emission device 2A, as can be seen FIG. 2, comprises an emission filament 15 whose shape as seen from overhead is substantially rectangular, so that its projection onto the anode 4 at an impact focal spot 5A is substantially rectangular, whose length is greater than its width. If no focusing voltage 6 is applied, the emission device 2A effectively emits a beam 3A of electrons whose focal spot 5A has a characteristic initial dimension 18A (e.g. the length) depending on the shape of the emission filament 15 of the said emission device 2A.

It is to be noted that the focusing cup 11, through its mechanical shape e.g. incurved and stepped, has an influence on focusing of the beam 3A and hence on the characteristic dimension or dimensions of the focal spot 5A.

In the most frequently used embodiment, as shown FIGS. 1 and 2, the assembly of polarizing plates 7 is positioned along the axis of the length of the emission filament 15 as seen from overhead. Therefore the characteristic dimension 18A controlled by the focusing voltage 6 is the length of the focal spot 5A.

It is possible to position the assembly 7 of polarizing plates along the axis of the width of the filament 15 as seen from overhead. In this case, the focusing voltage 6 provides control over the width of the focal spot 5A, said width of the focal spot 5A this time being the characteristic dimension 18A of the focal spot 5A.

It is possible simultaneously to control the length and the width of the focal spot 5A, by positioning an assembly 7 of polarizing plates along the axis of the length and width of the emission filament 15. In this case, two characteristic dimensions of the focal spot 5A are controlled.

The assembly 7 of polarizing plates can therefore be used to control the reduction of the characteristic dimension 18A of the focal spot 5A lying in the positioning axis of said assembly 7, irrespective of the geometric shape of the filament 15.

The cut-off voltage 9 applied to the cup 11 ensures a fluoro emission mode of the beam 3A of electrons by the device.

Periodic application of the cut-off voltage 9 periodically cuts off the emission of the beam 3A of electrons, through the repelling effect of the electrostatic forces applied to the beam 3A of electrons via the energized cup 11. In this way it is possible to obtain a beam 3A of electrons whose emission is completely cut off at periodic times. This gives an emission device operating in fluoro emission mode. The cut-off frequency of the beam 3A of electrons by the cut-off voltage 9 can be adjusted and varied over time according to user needs.

The cut-off voltage 9 applied to the cup 11 is a negative voltage, whose absolute value is higher than the absolute value of the acceleration voltage 20 of the beam 3A of electrons, applied to the emission device 2A. This allows a negative potential difference to be created between the emission device 2A and the cup 11. The electric generator 8 typically creates an electric potential difference of between −2 kV and −10 kV between the emission device 2A and the cup 11. For example, with an acceleration voltage 20 of −75 kV applied to the emission device 2A, a cut-off voltage 9 of −79 kV can be applied.

One advantage of the invention is therefore the providing of a beam 3A of electrons for which there is simultaneous control over its reduced characteristic dimension 18A and over emission mode, fluoro and record. In general, the invention offers very broad flexibility. The emission device 2A can notably be used in the following utilization modes: continuous emission mode; record emission mode; record emission mode with control over reducing the characteristic dimension 18A of the focal spot 5A; fluoro emission mode; and fluoro emission mode with control over reducing the characteristic dimension 18A of the focal spot 5A.

The continuous emission mode is obtained passively, without applying a cut-off voltage 9. The record emission mode is also obtained without applying a cut-off voltage 9, but by periodically cutting off the high acceleration voltage 20 applied to the emission device 2A. It is recalled that the acceleration voltage is the same in record mode as in fluoro mode (generally between 20 and 200 kV). Similarly, it is recalled that in fluoro mode the acceleration voltage is permanently maintained, but the cut-off voltage is periodically added thereto.

The record emission mode with reduction in the characteristic dimension 18A of the focal spot 5A, is obtained by applying a focusing voltage 6 to the assembly 7 of polarizing plates associated with the emission device 2A, while periodically cutting off the high acceleration voltage. The fluoro emission mode is obtained by applying a cut-off voltage 9 to the focusing cup 11 associated with the emission device 2A. The fluoro emission mode with reduction in the characteristic dimension 18A of the focal spot 5A is obtained by simultaneously applying a cut-off voltage 9 to the focusing cup 11 associated with the emission device 2A, and a focusing voltage 6 to the assembly 7 of polarizing plates associated with the emission device 2A. Various utilization modes are obtained, notably adapted to medical imaging applications (e.g. neurology, mammography, vascular imaging, CT-scanning, and conventional radiology). Examples are given below of emission devices implementing the methods and emission modes just described.

In one advantageous embodiment of the invention the emission device 2B, before any focusing voltage 6 is applied, emits a beam 3B of electrons onto a focal spot 5A whose characteristic dimension 18A is of small size i.e. lying between 0.4 and 0.8 mm. For this emission device 2A, the application of a focusing voltage 6 lower than the acceleration voltage 20 of the beam 3A of electrons applied to said device 2A, with a value of between −2 kV and −6 kV, allows a focal spot 5A to be obtained whose characteristic dimension 18A is very small in size i.e. lying between 0.1 and 0.5 mm. By applying the focusing voltage 6 simultaneously with a cut-off voltage 9, a beam 3A of electrons is obtained that is emitted in fluoro mode and whose focal spot 5A has a characteristic dimension 18A of between 0.1 and 0.5 mm, this type of beam being given particular use in neurology. If no cut-off voltage 9 is applied simultaneously with the focusing voltage 6, but if the high acceleration voltage 20 of the beam 3A of electrons applied to the emission device 2A is periodically cut off, a beam 3A of electrons is obtained that is emitted in record emission mode whose focal spot 5A has a characteristic dimension 18A of between 0.1 and 0.5 mm.

For this emission device 2A the modes available are therefore continuous, fluoro and record emission modes with a focal spot 5A of characteristic dimension 18A lying between 0.4 and 0.8 mm, and continuous, fluoro and record emission modes with a focal spot 5A whose characteristic dimension 18A lies between 0.1 and 0.5 mm, which provides very wide flexibility of use.

Alternatively, another emission device 2B can be used, emitting a beam 3B of electrons onto an impact spot 5B. The functioning of emission device 2B will not be further described since said functioning is identical to that of the previously described emission device 2A.

In one advantageous embodiment of the invention the emission device 2B, before any focusing voltage 6 is applied, emits a beam 3B of electrons onto a focal spot 5B whose characteristic dimension 18B is of large size i.e. between 1.0 and 1.5 mm.

The application of a focusing voltage 6 lower than the acceleration voltage 20 applied to the emission device 2B, of value between −2 kV and −6 kV, allows a focal spot 5B to be obtained of which one characteristic dimension 18B is of large size lying between 0.7 and 1.2 mm, and the applying of focusing voltage 6 lower than the acceleration voltage 20 applied to the emission device 2B, of value between −4 kV and −10 kV, allows a focal spot 5B to be obtained of which one characteristic dimension 18B is of small size i.e. lying between 0.4 and 0.8 mm. For each focusing voltage 6, the simultaneous, periodical application of a cut-off voltage 9 allows a beam 3B of electrons to be obtained that is emitted in fluoro mode and whose focal spot 5B has a characteristic dimension 18B that is controlled by said focusing voltage 6. If no cut-off voltage 9 is applied simultaneously with the focusing voltage 6, but if the high acceleration voltage 20 of the beam 3B of electrons applied to the emission device is periodically cut off, a beam 3B of electrons is obtained emitted in record emission mode whose focal spot 5B has a characteristic dimension 18B controlled by said focusing voltage 6. For this emission device 2B, the modes available are therefore continuous, fluoro and record emission modes with a focal spot 5B of characteristic dimension 18B lying between 1.0 and 1.5 mm, continuous, fluoro and record emission modes with a focal spot 5B of characteristic dimension 18B lying between 0.7 and 1.2 mm, and also continuous, fluoro and record emission modes with a focal spot 5B of characteristic dimension 18B lying between 0.4 and 0.8 mm.

In one advantageous embodiment of the invention, the cathode 1 of the invention comprises a first emission device 2A and a second emission device 2B, which are used alternately. Advantageously, the electric generator 8 alternately controls the first device 2A and the second device 2B by applying the following alternate command: first, the generator 8 applies a cut-off voltage 9 to the focusing cup 11 associated with the first emission device 2A, whose emitted beam 3A focuses on a first focal spot 5A on the anode 4 with a first characteristic impact dimension 18A; and second, the generator 8 simultaneously applies a focusing voltage 6 and a cut-off voltage 9 for the second emission device 2B, whose emitted beam 3B focuses on a second focal spot 5B on the anode 4 with a second characteristic impact dimension 18B. The focusing voltage 6 is chosen so that the first dimension 18A and the second dimension 18B are substantially equal.

The above-described alternate command therefore allows two beams (3A, 3B) of electrons to be emitted in fluoro emission mode and whose focal spots (5A, 5B) have substantially equal characteristic dimensions (18A, 18B). Given the small size of the focal spots, by "substantially equal" is meant a difference of up to 0.2 mm.

Advantageously, the first device 2A emits a beam 3A of electrons whose focal spot 5A has a characteristic dimension 18A, before the application of any focusing voltage 6, of between 0.4 and 0.8 mm, and the second device 2B emits a beam 3B of electrons whose focal spot 5B has a characteristic dimension 18B, before any focusing voltage 6 is applied, of between 1.0 mm and 1.5 mm, these emission devices having been previously described in the two first sections of this description.

Under the previously described alternate controlling, the application of a focusing voltage 6 to the assembly 7 of polarizing plates associated with the second device 2B, lower than the acceleration voltage 20 applied to the second device and of value between −4 kV and −10 kV, allows a beam 3B of electrons to be obtained whose focal spot has a characteristic dimension 18B lying between 0.4 mm and 0.8 mm. The focal spot 5B therefore has its characteristic dimension 18B reduced from the range of 1.0 to 1.5 mm to the range of 0.4 mm to 0.8 mm. This gives two emission devices (2A, 2B), which alternately emit electron beams in fluoro emission mode, the characteristic dimension (18A, 18B) of the focal spot (5A, 5B) being substantially equal and preferably lying in the range of 0.4 mm to 0.8 mm.

This is of great advantage, notably in some medical imaging applications. The fluoro emission mode associated with a focal spot of characteristic dimension lying between 0.4 mm and 0.8 mm is given extensive use, in particular for vascular imaging. By means of the invention, two emission devices (2A, 2B) are provided able to ensure fluoro emission and a focal spot with characteristic dimension between 0.4 mm and 0.8 mm. The advantage in particular is to make alternate use of the two emission devices (2A, 2B) in order to extend their lifetime. Intensive use of a single emission device for a given application effectively damages the said device over the long term. The invention therefore allows the lifetime of the cathode 1 to be extended as well as the lifetime of its emission devices (2A, 2B).

Additionally, another advantage is related to the fact that there are two emission devices (2A, 2B) able to emit a beam of electrons in fluoro emission mode and with a focal spot having a characteristic dimension of between 0.4 mm and 0.8 mm, and that it is possible to increase the emission temperature of the emission devices (2A, 2B) by increasing the electric current applied to these emission devices (2A, 2B), which allows the image quality to be increased without reducing the lifetime of the cathode. Since these two devices (2A, 2B) are used half as much (since they can be used alternately for the same application) it is possible to heat them to a higher temperature without necessarily reducing the lifetime of the cathode containing the emission devices (2A, 2B). Therefore an increase in the temperature of the emission device is reconciled with obtaining a focal spot of reduced size, whilst maintaining a long lifetime.

Also, another advantage is that there is provided an emission device 2B comprising a large filament (since the filament of device 2B, before the application of any focusing voltage 6, has a focal spot of characteristic dimension 18B between 1.0 mm and 1.5 mm), which is nevertheless capable of emitting an electron beam having a focal spot of characteristic small dimension 18B (between 0.4 mm and 0.8 mm). The fact that a large filament is provided allows the emission temperature of said filament to be increased, whilst maintaining a long lifetime, and further having a focal spot of reduced characteristic dimension by means of the applied polarizing voltage.

In addition to the alternate commanding previously described, the fact that there are two emission devices (2A, 2B), or more, means that it is possible to use each emission device alternately in all the emission modes previously described in the first two sections of the present description i.e. the continuous, fluoro and record emission modes with or without control over the reduction in the characteristic dimension of the focal spot. The characteristic dimensions of the focal spots (5A, 5B) which are obtained are advantageously those previously given for each emission device (2A, 2B) in the first two sections of the present description.

If the cathode 1 comprises at least two emission devices (2A, 2B), it is advantageous for each emission device (2A, 2B) to contain an emission filament 15 of different geometric configuration from one device to another, so as to obtain focal spots of different characteristic dimension, and devices having different powers, which increases the possibilities of application.

By geometric configuration is meant, but not limited thereto, the geometric shape of the filament as seen from overhead and/or the size of its cross-section and/or the shape of its cross-section and/or its thickness. Evidently, the cross-section of the filament has particular influence on the emitting power of said filament. The geometric shape of the filament from an overhead view particularly influences the characteristic dimension(s) of the focal spot to be controlled. As can be ascertained, the invention provides very extensive flexibility of use.

Figure 3:
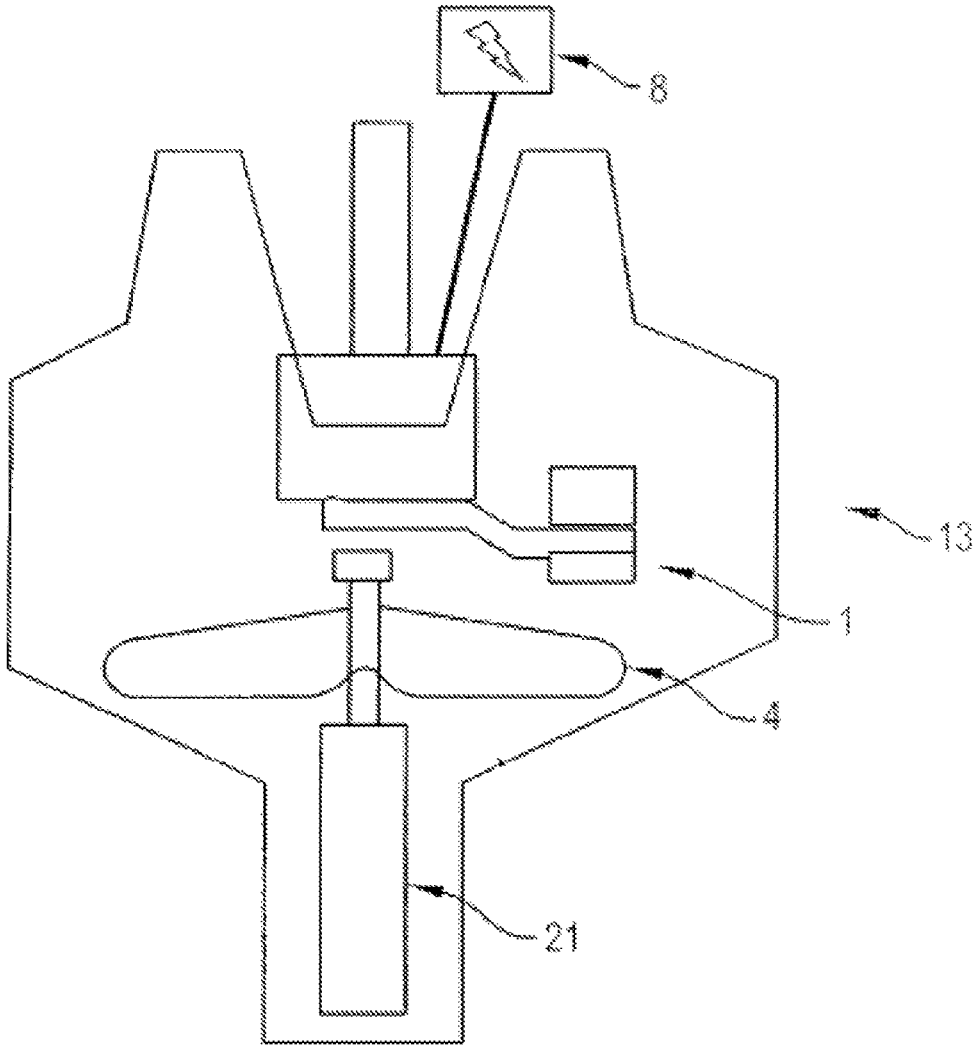
FIG. 3 is a schematic illustration of an X-ray imaging tube according to the invention.

FIG. 3 shows an X-ray imaging tube 13 according to the invention. The tube comprises an anode 4. The anode 4 may rotate and be mounted on a rotor 21. The material of the surface of the anode 4 is typically tungsten. The body of the anode 4 generally contains molybdenum to reinforce mechanical resistance. The tube 13 also comprises the cathode 1 of the invention, capable of emitting a beam 3 of electrons towards the anode 4, for which it is possible to control both the emission mode and a characteristic dimension of the focal spot 5 via the cut-off voltage 9 and focusing voltage 6 applied by the electric generator 8

The beam of electrons is accelerated by the acceleration voltage 20 in the vacuum between the cathode 1 and the anode 4. The vacuum prevailing therein is in the order of 10.sup.-8 Torr. The interaction between the beam of electrons and the material of the surface of the anode 4 then allows the generation of X-rays.

The X-ray imaging tube 13 is advantageously incorporated in an X-ray imaging system. The imaging system also comprises the electric generator 8 able to apply simultaneously the focusing voltage 6 and the cut-off voltage 9 to at least one emission device (2A, 2B) of the cathode 1.

The imaging systems notably comprise X-ray scanning machines for X-ray tomography. These imaging systems are advantageously used in the areas of medical imaging, in particular cardiovascular, neurological imaging, mammography and angiography techniques, bone radiography, scanner imaging and conventional radiology.

What is claimed:

1. A method for controlling an emission of a beam of electrons in an X-ray imaging tube, the X-ray imaging tube comprising an anode and a cathode comprising a first emission device associated with a first assembly of polarizing plates located on either side of a first focusing cup and a second emission device associated with a second assembly of polarizing plates located on either side of a second focusing cup, wherein the method comprises:

alternately emitting an accelerated incident beam of electrons from the first emission device onto a first focal point on the anode and from the second emission device onto a second focal point on the anode to generate X-rays;

applying, to the first emission device, by an electric generator a first beam focusing voltage to at least one of the first assembly of polarizing plates and the first focusing cup;

applying, to the second emission device, by an electric generator a second beam focusing voltage to at least one of the second assembly of polarizing plates and the second focusing cup;

applying a first cut-off voltage to the first focusing cup to control the emission of the beam; and applying a second cut-off voltage to the second focusing cup to control the emission of the beam, wherein the first focal point has a first characteristic impact dimension and the second focal point has a second characteristic impact dimension, and wherein the first characteristic impact dimension and the second characteristic impact dimension are substantially equal.

2. The method according to claim 1, wherein the first beam focusing voltage is between −2 kV and −6 kV less than an acceleration voltage of the beam of electrons applied to the first emission device, and wherein the first characteristic impact dimension of the first focal point is between 0.1 mm and 0.5 mm.

3. The method according to claim 1, wherein the second beam focusing voltage is between −2 kV and −6 kV less than an acceleration voltage of the beam of electrons applied to the second emission device, and wherein the second characteristic impact dimension of the second focal point is between 0.7 mm and 1.2 mm.

4. The method according to claim 1, wherein the second beam focusing voltage is between −4 kV and −10 kV less than an acceleration voltage of the beam of electrons applied to the second emission device.

5. The method according to claim 1, wherein the second beam focusing voltage applied to the second emission device is between −4 kV and −10 kV less than an acceleration voltage of the beam of electron applied to the second emission device, and wherein the first characteristic impact dimension and the second characteristic impact dimension are substantially equal and are between 0.4 mm and 0.8 mm.

* * * * *

UNITED STATES PATENT AND TRADEMARK OFFICE

CERTIFICATE OF CORRECTION

PATENT NO. : 8,498,378 B2
APPLICATION NO. : 12/829850
DATED : July 30, 2013
INVENTOR(S) : Lemarchand et al.

It is certified that error appears in the above-identified patent and that said Letters Patent is hereby corrected as shown below:

In the Specifications

In Column 10, Line 11, delete “beam 3” and insert -- beam --, therefor.

In Column 10, Line 14, delete “spot 5” and insert -- spot --, therefor.

In Column 10, Line 15, after “generator 8”, insert -- . --.

Signed and Sealed this
Twenty-fourth Day of December, 2013

Margaret A. Focarino

Margaret A. Focarino
*Commissioner for Patents of the United States Patent and Trademark Office*